US007343979B2

(12) United States Patent
Dreggevik

(10) Patent No.: US 7,343,979 B2
(45) Date of Patent: Mar. 18, 2008

(54) METHOD AND DEVICE FOR THE CONTROLLED DISCONNECTION OF A WIRELINE

(75) Inventor: Mikal Dreggevik, Tau (NO)

(73) Assignee: Smedvig Offshore AS, Stavanger (NO)

( * ) Notice: Subject to any disclaimer, the term of this patent is extended or adjusted under 35 U.S.C. 154(b) by 117 days.

(21) Appl. No.: 10/551,337

(22) PCT Filed: Apr. 1, 2004

(86) PCT No.: PCT/NO2004/000093

§ 371 (c)(1),
(2), (4) Date: Feb. 6, 2006

(87) PCT Pub. No.: WO2004/090280

PCT Pub. Date: Oct. 21, 2004

(65) Prior Publication Data

US 2007/0023191 A1 Feb. 1, 2007

(30) Foreign Application Priority Data

Apr. 11, 2003 (NO) ..... 20031667

(51) Int. Cl.
*E21B 17/06* (2006.01)

(52) U.S. Cl. ..... 166/377; 166/65.1; 166/57

(58) Field of Classification Search ..... 166/377, 166/65.1, 57
See application file for complete search history.

(56) References Cited

U.S. PATENT DOCUMENTS

| | | | | |
|---|---|---|---|---|
| 3,327,784 | A | 6/1967 | Pardue | |
| 5,058,683 | A | 10/1991 | Godfrey et al. | |
| 6,032,733 | A * | 3/2000 | Ludwig et al. | 166/60 |
| 6,053,262 | A * | 4/2000 | Ferguson et al. | 175/321 |
| 6,269,883 | B1 * | 8/2001 | Gissler et al. | 166/340 |
| 6,349,767 | B2 * | 2/2002 | Gissler | 166/242.6 |
| 6,431,269 | B1 | 8/2002 | Post et al. | |

FOREIGN PATENT DOCUMENTS

| | | |
|---|---|---|
| EP | 0552087 | 7/1993 |
| EP | 0898046 | 2/1999 |
| EP | 1197631 | 4/2002 |

* cited by examiner

*Primary Examiner*—William P. Neuder
*Assistant Examiner*—Nicole Coy
(74) *Attorney, Agent, or Firm*—Ladas & Parry LLP

(57) ABSTRACT

A method and device for controlling the disconnection of a wireline (4), of the kind used in wireline operations in a wellbore, from a wireline tool (8), the wireline (4) being provided with a conductor (6) arranged to communicate signals, the signals being monitored at the wire-line tool (8) by means of a lower monitoring and control circuit (24), and the lower monitoring and control circuit (24) activating, by disappearance of signals from the surface, a disconnect device (12) after a predetermined time, the disconnect device (12) being arranged to disconnect the wireline (4) from the wireline tool (8).

4 Claims, 5 Drawing Sheets

METHOD AND DEVICE FOR THE CONTROLLED DISCONNECTION OF A WIRELINE

BACKGROUND OF THE INVENTION

1. Field of the Invention

This invention relates to a method for controlling the disconnection of a wireline. More particularly it concerns a method for initiating the disconnection of a wireline from a wireline tool after the wireline tool has become stuck and the wireline has possibly been damaged. The invention also includes a device for practicing the method.

2. Discussion of the Prior Art

In wireline operations in a wellbore it may happen that the wireline tool becomes stuck. Then, when the wireline tool is to be freed, or otherwise in unfavourable conditions and in incorrect manoeuvring, it may happen that one or more of the conductors of the wireline are damaged and that the unit in the wellbore will thereby be without contact with an operator on the surface.

In order to access the tool assembly with a so-called fishing tool, the wireline portion present in the wellbore must first be removed.

According to the prior art, a wireline, which is to be used in wireline operations, is provided with a weakened portion near its point of attachment in the wireline tool. The weakening is normally provided by removal of a portion of the strands of the wireline. The purpose of the weakening is that a possible wireline rupture is to be directed to this weakened portion, so that after rupturing, essentially the entire wireline can be pulled up to the surface. The wireline tool may then be retrieved by means of a so-called fishing tool.

It is evident that the method mentioned reduces the carrying capacity of the wireline to a substantial degree, and may therefore cause unnecessary rupturing of the wireline and a considerable reduction in the permitted total weight of the tool that may be used.

The invention has as its object to remedy the drawbacks of the prior art.

The object is realized according to the invention through the features specified in the description below and in the following Claims.

Prior art wireline tools are often provided with electric equipment, which is arranged to communicate with instruments on the surface during the wireline operations. Thus, it is common for the wireline to be provided with a bundle of electrical conductors, referred to below as a conductor, arranged to transfer electrical signals and possibly also electrical power for the operation of equipment in the wireline tool.

SUMMARY OF THE INVENTION

According to the invention the signal flow in the conductor of the wireline at the wireline tool is monitored by means of a lower control apparatus in a manner known per se. Should the signal flow from the surface cease, this indicates that the wireline is damaged, possibly ruptured. After a predetermined time, the lower control apparatus initiates a disconnection of the wireline from the wireline tool by means of a disconnect device arranged in connection with the wireline tool.

In a preferred embodiment the conductor also extends through a monitoring and control apparatus on the surface, referred to below as the upper control apparatus, in which the signal flow through the conductor is monitored essentially without affecting the signal flow. The upper control apparatus is preferably provided with a display window, in which the state of the disconnect device is shown, and in which a warning of a begun disconnecting operation is given at the same time as an acoustic alarm is emitted by, for example, a bell.

The upper control apparatus is also provided with an override function, which is arranged to initiate disconnection of the wireline from the wireline tool, or to interrupt an erroneously initiated disconnection. Before the upper control apparatus can take over the control of the lower control apparatus, the conductor must be connected, by means of manual reconnection, to the control circuit of the upper control apparatus.

The wireline being automatically disconnected from the wireline tool on a possible wireline rupture, the wireline portion present in the wellbore can relatively easily be retrieved from the wellbore, so that access to the wireline tool with a fishing tool is facilitated.

The disconnect device may be of an embodiment of electro-mechanical or electro-chemical activation, for example.

The device is also suitable for disconnecting the wireline from the wireline tool if the wireline tool is stuck and it is not desirable to risk breaking the wireline in an attempt to free the wireline tool.

In what follows, a non-limiting example of a preferred embodiment will be described, which is visualized in the accompanying drawings, in which:

BRIEF DESCRIPTION OF THE DRAWING FIGS.

DESCRIPTION OF THE PREFERRED EMBODIMENTS

Figure 1:
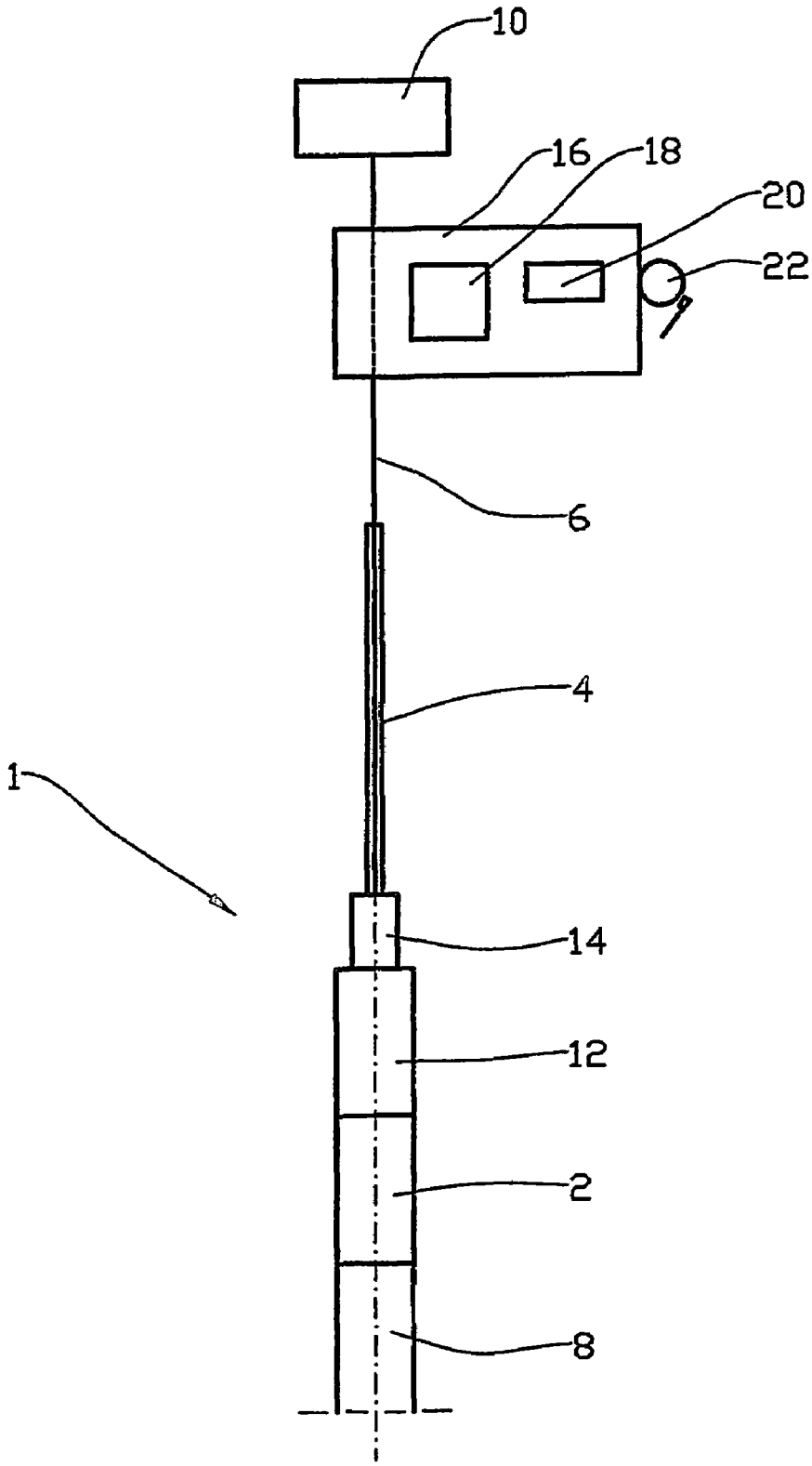
FIG. 1 shows schematically the components incorporated in a disconnection control.
Figure 2:
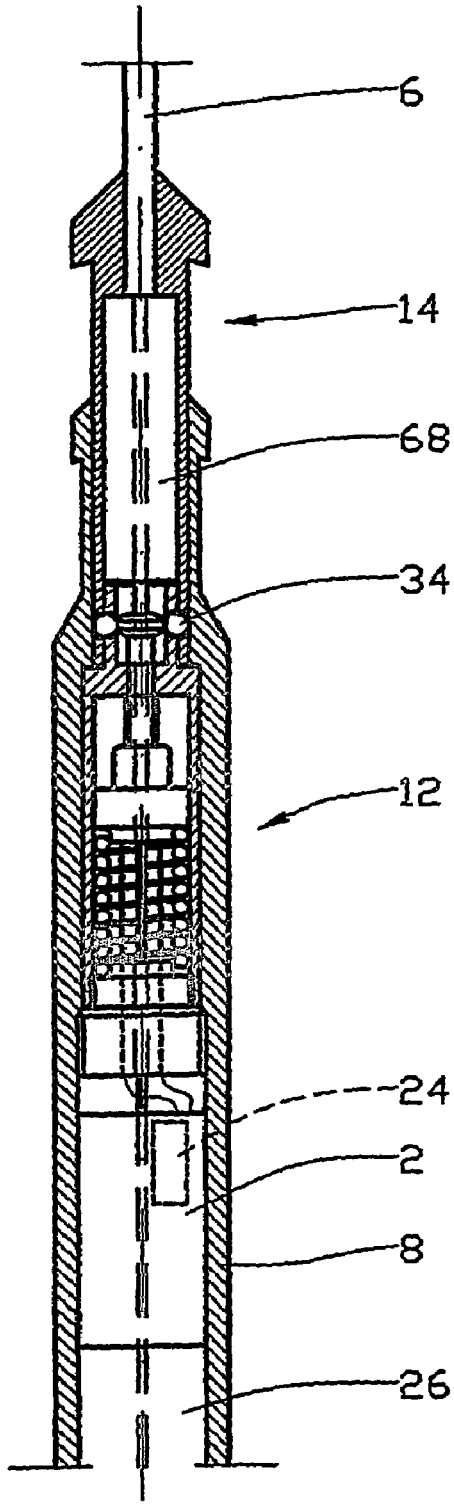
FIG. 2 shows on a larger scale the wireline attachment area in the wireline tool.

In the drawings the reference numeral 1 identifies a disconnection control comprising a lower control apparatus 2, which is arranged to monitor the signal flow in the conductor 6 of a wireline 4 between a wireline tool 8 and a computer 10 on the surface.

Figure 3:
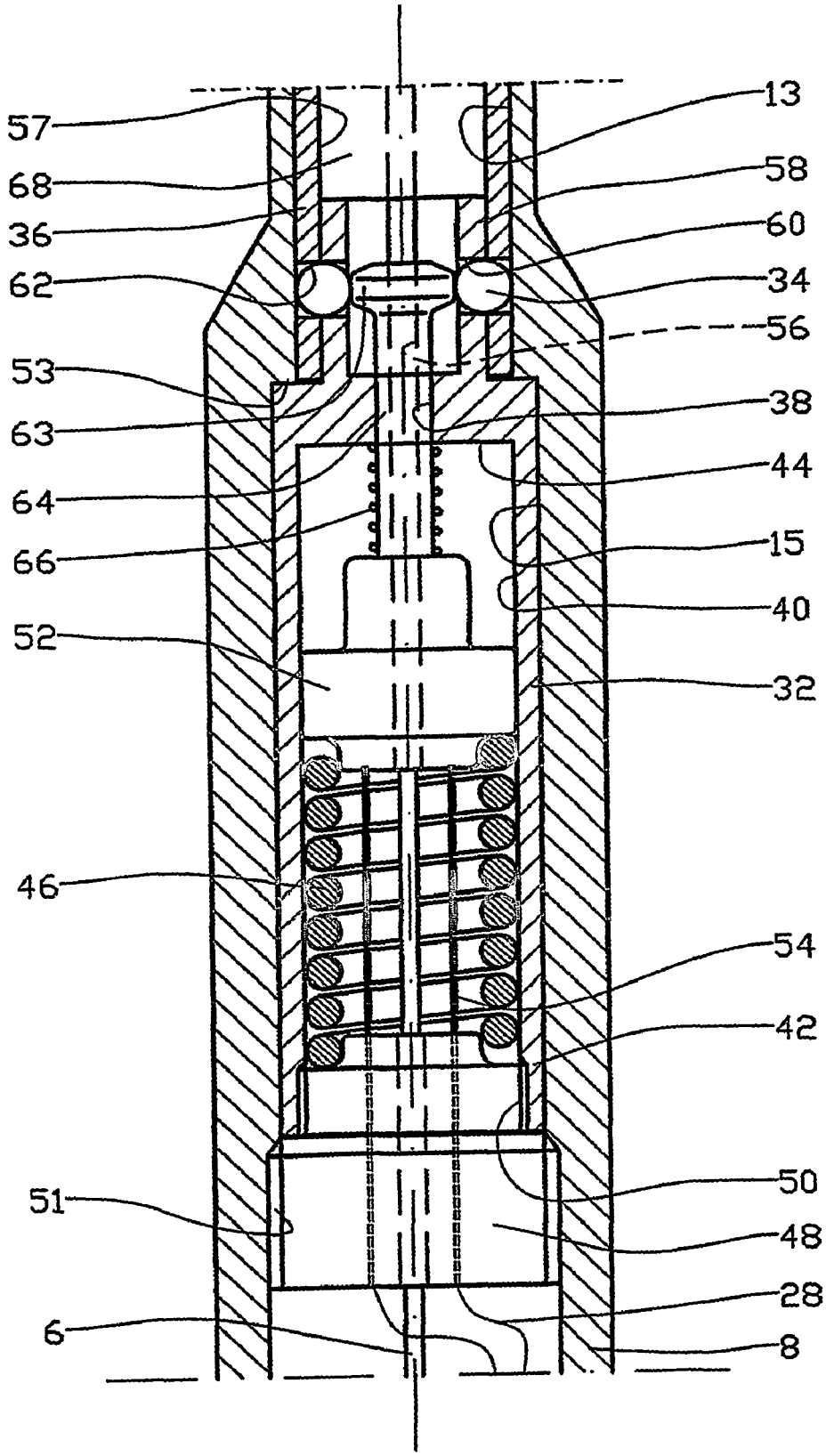
FIG. 3 shows on an even larger scale the disconnect device in a locking position.

The lower control apparatus 2 is connected to and controls a disconnect device 12. The disconnect device 12 forms a load-carrying connection between the wireline tool 8 and the wireline 4 through a wireline attachment 14. The wireline attachment 14 is arranged to transmit a load corresponding to the breaking load of the wireline 4 to the disconnect device 12, and is disposed in a first bore 13 of the wireline tool 8, see FIG. 3. The first bore 13 ends in a second bore 15 of the wireline tool 8, in which the disconnect device 12 is placed.

An upper control apparatus 16 is arranged on the surface and connected to the conductor 6 in such a way that the signal flow in the conductor 6 can be monitored in a manner known per se by means of an upper monitoring and control circuit 18 without disturbing the signal flow. The upper control apparatus is provided with a display window 20, which is arranged to show the state of the disconnect control 1, and a bell 22, which is arranged to give a signal when the disconnecting operation is initiated.

The upper control apparatus 16 is also arranged, after the conductor 6 has been reconnected in the upper control apparatus 16, to override the lower control apparatus 2 to initiate disconnection, or if the conductor 6 is intact, to interrupt an erroneously initiated disconnecting operation.

The lower control apparatus 2, which is placed in the wireline tool 8 at the disconnect device 12, includes a lower monitoring and control circuit 24 which is arranged to monitor the signal flow in the conductor 6 without disturbing the signal flow. The lower control apparatus 2 and the disconnect device 12 are supplied with energy from a battery 26. The disconnect device 12 is connected to the lower control apparatus 2 by wires 28.

The disconnect device 12 includes a releaser housing 32, which is fixed to the wireline tool 8 and can be released by means of locking bodies 34 connected to the mounting sleeve 36 of the wireline attachment 14. The releaser housing 32 is provided with a through central bore 38, which is arranged to form a passage for the conductor 6 of the wireline 4. In a diametrically widened portion 40 of the bore 38, the portion 40 extending from the lower end portion 42 of the releaser housing 32 inwards to a shoulder 44, a release spring 46 is disposed.

The release spring 46 is mounted between a spring retainer 48, which is connected to the lower end portion 42 by means of threads 50, and a release piston 52. The release spring 46 is kept in a tensioned position by means of a number of electrically conductive and isolated load carrying strands 54 extending between the spring retainer 48 and the release piston 52. The spring retainer 48 is arranged to tighten the releaser housing 32, by means of the threads 51, against a shoulder 53 between the bores 13 and 15 of the wireline tool 8.

The strands 54, which are preferably provided with weakened portions, are connected to the lower monitoring and control circuit 24 by means of the wires 28.

The release piston 52 is provided with a through central bore 56 for the passing of the conduit 6 and is movably arranged within the bore 38.

At its end portion facing the releaser housing 32, the mounting sleeve 36 is provided with an internal bore 57, complementarily fitting externally round the projecting locking neck 58 of the releaser housing 32. The locking neck 58 is provided with at least two through radial bores 60 evenly spaced round the locking neck 58, corresponding with suitable bores 62 of the mounting sleeve 36.

Each of the corresponding bores 60, 62 is provided with a respective locking body 34 in the form of a ball. The diameter of the locking bodies 34 is adapted in such a way that the centre of the locking bodies 34 is positioned within the diameter of the bore 57. The locking bodies 34 are retained in their locking position, in which the mounting sleeve 36 cannot be moved out of the locking neck 58, by a bead 63 on the piston-rod-like portion 64 of the release piston 52. The release piston 52 is prevented from being displaced from its locking position by a relatively weak support spring 66, which is pre-tensioned between the shoulder 44 and the release piston 52.

A clamp 68 gripping round the wireline and complementarily fitting into the bore 57 of the mounting sleeve 36 forms the wireline attachment 14.

Figure 4:
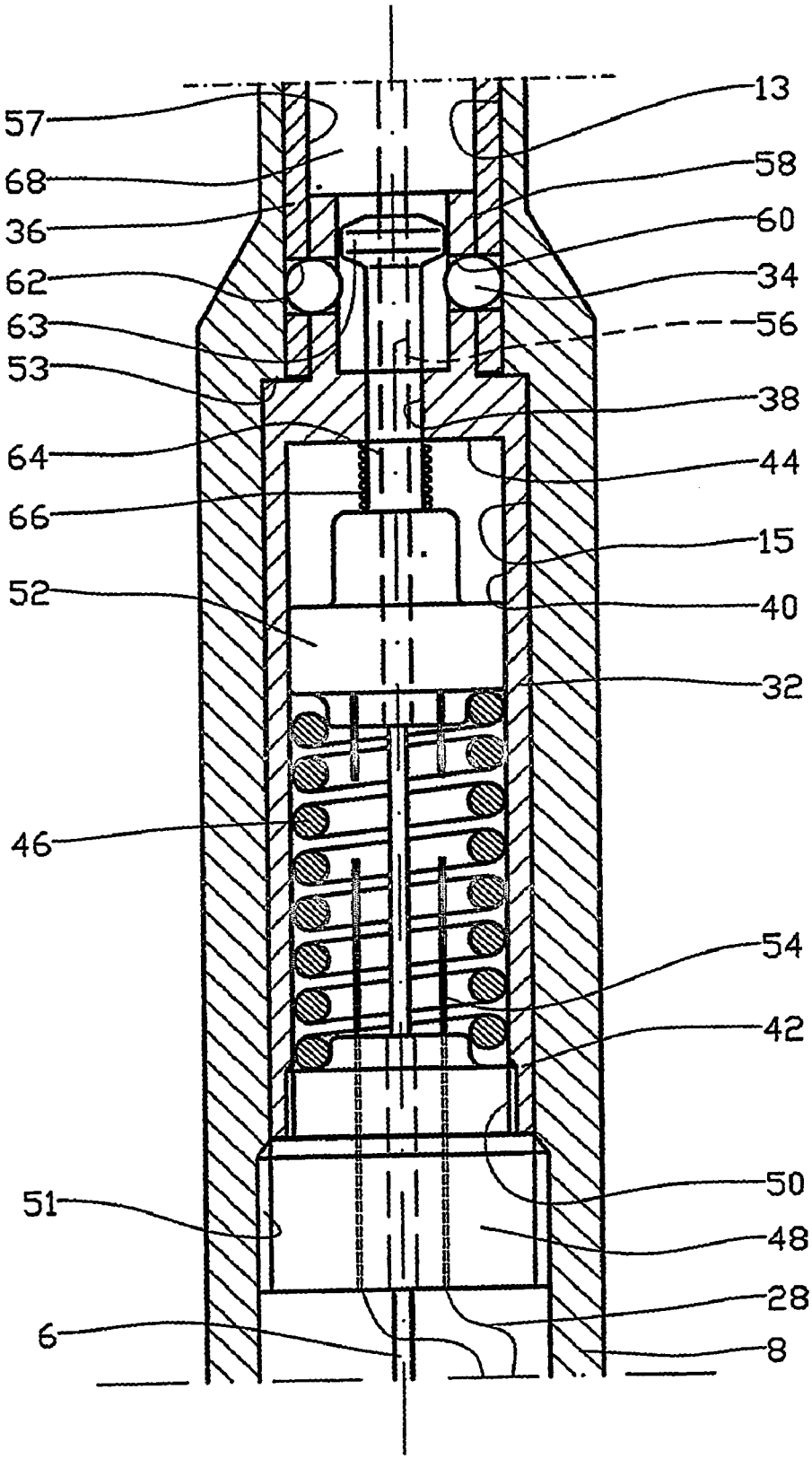
FIG. 4 shows the disconnect device as the first part of the release has been carried out.

When the lower monitoring and control circuit 14 does not pick up any signals through the conductor 6 from the computer 10, voltage is coupled, after a predetermined time has passed, from the battery 26 through the wires 28 to the strands 54. The strands 54 are heated, due to their electrical resistance, until they lose their strength, possibly melt, so that the release spring 64 can overcome the force of the support spring 66, whereby the release piston 52 is moved axially within the releaser housing 32 into its releasing position, see FIG. 4.

Figure 5:
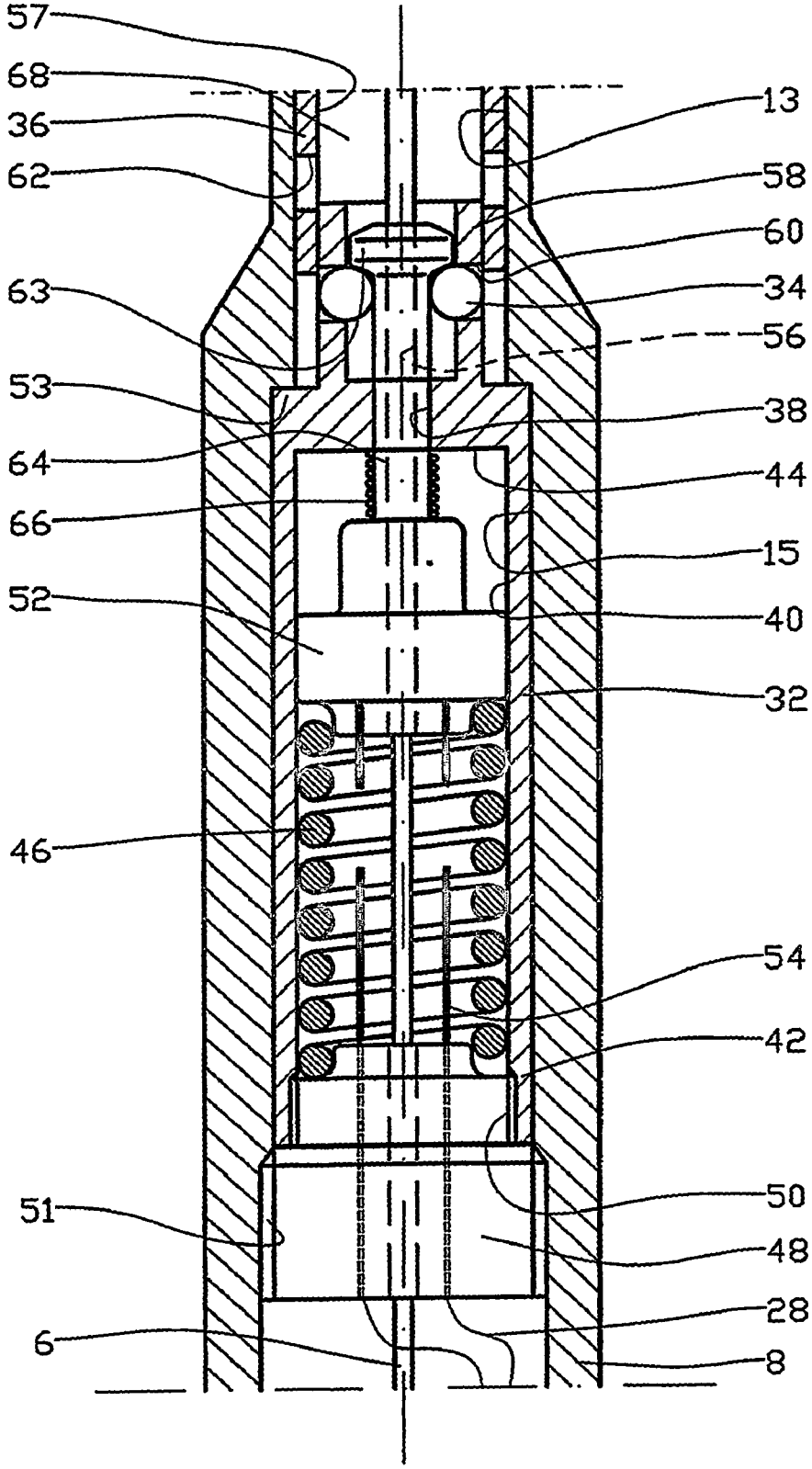
FIG. 5 shows the disconnect device as the wireline has been released and the wireline attachment is on its way out of the wireline tool.

When the release piston 52 is in this releasing position, the bores 60 no longer correspond with the bead 63 on the piston-rod-like portion 64, whereby the locking bodies 34 can be moved radially inwards out of their locking engagement within the bores 62. Thereby, the mounting sleeve can be moved out of the locking neck 58, whereby the wireline 4 is released from the wireline tool 8, see FIG. 5. The wireline with the wireline mounting 14 can then be pulled up to the surface.

The invention claimed is:

1. A method for controlling the disconnection of a wireline, of the kind used in wireline operations in a wellbore, from a wireline tool, the method comprising the steps of:

providing the wireline with a conductor arranged to communicate signals, monitoring the signals at the wireline tool by means of a lower monitoring and control circuit, and by disappearance of signals from a surface, the lower monitoring and control circuit activating a disconnect device after a predetermined time, the disconnect device being arranged to disconnect the wireline from the wireline tool.

2. A method according to claim 1, further comprising the step of activating or interrupting the disconnection of the wireline from a surface located monitoring and control unit.

3. A method according to claim 2, further comprising the step of monitoring the signals by the surface located monitoring and control unit, which gives a warning on activation of a disconnecting operation.

4. A device for controlling the disconnection of a wireline, of the kind used in wireline operations in a wellbore, from a wireline tool, the wireline being provided with a conductor arranged to communicate signals, wherein a lower monitoring and control circuit disposed at the wireline tool is arranged to monitor the signals on the conductor and by disappearance of signals from the surface to activate, after a predetermined time, a disconnect device which is arranged to disconnect the wireline from the wireline tool.

* * * * *